US006884956B2

(12) United States Patent
Murata et al.

(10) Patent No.: US 6,884,956 B2
(45) Date of Patent: Apr. 26, 2005

(54) COLOR-BASED SORTING APPARATUS

(75) Inventors: Takehiro Murata, Tendo (JP); Tsuneyoshi Goto, Tendo (JP); Mikio Tamura, Tsuruoka (JP); Kenichi Kikuchi, Tsuruoka (JP)

(73) Assignee: Kabushiki Kaisha Yamamoto-Seisakusho, Yamagata-ken (JP)

( * ) Notice: Subject to any disclaimer, the term of this patent is extended or adjusted under 35 U.S.C. 154(b) by 143 days.

(21) Appl. No.: 10/291,507

(22) Filed: Nov. 12, 2002

(65) Prior Publication Data

US 2003/0094403 A1 May 22, 2003

(30) Foreign Application Priority Data

Nov. 19, 2001 (JP) ..... 2001-353647

(51) Int. Cl.[7] ..... B07C 5/342

(52) U.S. Cl. ..... 209/580; 209/576; 209/578; 209/581; 209/582; 209/638; 209/639; 209/640

(58) Field of Search ..... 209/580, 576, 209/578, 581, 582, 638, 639, 640, 637, 644, 657, 656

(56) References Cited

U.S. PATENT DOCUMENTS

| | | | | | |
|---|---|---|---|---|---|
| 2,726,762 | A | * | 12/1955 | Aubry | 209/581 |
| 3,482,686 | A | * | 12/1969 | Wood | 209/587 |
| 4,252,240 | A | * | 2/1981 | Satake | 209/580 |
| 4,276,983 | A | * | 7/1981 | Witmer | 209/587 |
| 4,373,638 | A | * | 2/1983 | Schapper | 209/570 |
| 4,830,194 | A | * | 5/1989 | Kajiura et al. | 209/580 |
| 4,940,850 | A | * | 7/1990 | Satake | 209/580 |
| 4,946,046 | A | * | 8/1990 | Affleck et al. | 209/580 |
| 5,148,923 | A | * | 9/1992 | Fraenkel et al. | 209/539 |
| 5,509,537 | A | * | 4/1996 | Crismon et al. | 209/577 |
| 5,638,961 | A | * | 6/1997 | Satake et al. | 209/580 |
| 5,713,473 | A | * | 2/1998 | Satake et al. | 209/580 |
| 5,779,058 | A | * | 7/1998 | Satake et al. | 209/581 |
| 5,865,990 | A | * | 2/1999 | Novak et al. | 209/579 |
| 6,013,887 | A | * | 1/2000 | Satake et al. | 209/581 |
| 6,056,127 | A | * | 5/2000 | Low et al. | 209/639 |
| 6,100,488 | A | * | 8/2000 | Satake et al. | 209/580 |
| 6,482,686 | B1 | * | 11/2002 | Takemura | 438/166 |
| 6,629,611 | B2 | * | 10/2003 | Satake et al. | 209/657 |

FOREIGN PATENT DOCUMENTS

| | | |
|---|---|---|
| JP | 60-166274 U | 12/1975 |
| JP | A-59-76585 | 5/1984 |
| JP | 60-54772 A | 3/1985 |
| JP | A-60-161782 | 8/1985 |
| JP | A-61-136473 | 6/1986 |
| JP | A-63-200877 | 8/1988 |
| JP | 09-122606 | 5/1997 |
| JP | A-2000-237697 | 9/2000 |
| JP | A-2000-354831 | 12/2000 |
| JP | A-2001-62406 | 3/2001 |
| JP | 2001-174411 A | 6/2001 |
| JP | A-2001-272353 | 10/2001 |
| JP | A-2001-356051 | 12/2001 |
| JP | A-2002-18364 | 1/2002 |

* cited by examiner

*Primary Examiner*—Donald P. Wilson
*Assistant Examiner*—Jonathan R. Miller
(74) *Attorney, Agent, or Firm*—Taiyo, Nakajima & Kato

(57) ABSTRACT

A color-based sorting apparatus comprising, a material supplying device provided so as to discharge and supply the grains stored therein, a color detecting device detecting a color of each of the grains passing through a setting region, a sorting processing section operating to change a transference path for defective grains, a control device, which determines whether each of the grains to be sorted is defective or not based on a detection signal from the color detecting device, and when it is determined that one of the grains is defective, the control device activating the sorting processing section, and a feeding roll disposed between the material supplying device and the color detecting device and rotating around an axial line thereof to cause the grains to be sorted, which are supplied from said material supplying device aligned in an axial direction, to freely fall down toward the color detecting device.

18 Claims, 7 Drawing Sheets

COLOR-BASED SORTING APPARATUS

BACKGROUND OF THE INVENTION

1. Field of the Invention

The present invention relates to a color-based sorting apparatus in which it is determined whether grains to be sorted, such as cereal grains are defective or not based on the color of each grain while the grains are being transferred along a predetermined transference path, and when a grain is determined to be inferior, the inferior grain is sorted out.

2. Description of the Related Art

It is necessary to sort cereal grains such as rice grains or soybean into non-defective grains which can be commercialized and defective grains which cannot be commercialized in a predetermined refining process after harvesting. Particularly, in a case of polished rice, unless foreign substances or rice grains discolored in black, brown or the like are previously removed as defective grains as far as possible, the commercial value thereof may be deteriorated. Further, in many other cereal grains than polished rice as well, if foreign substances or defective grains discolored due to spoilage and/or damage or the like are mixed in, the commercial value of the grains may be deteriorated.

Accordingly, a color-based sorting apparatus has been conventionally proposed in which cereal grains such as rice grains or soybeans are sorted and separated based on reflection factors thereof. In this type of color-based sorting apparatus, there is a color-based sorting apparatus provided with a supplying section for supplying cereal grains to a sorting section, an image pickup section for picking up images of cereal grains under a predetermined quantity of light, a determination section for determining each grain whether the grain is defective or not based on the obtained image, and a sorting section for sorting out the grains which are determined as defective grains.

In the aforementioned color-based sorting apparatus, cereal grains slide and move in a predetermined groove of a narrow flowing passage (a so-called chute) which is sloped and is provided in the supplying section, and fall down from a terminal portion of the supplying section through a predetermined path. Images of each of the grains which are falling are picked up by the image pickup section which includes a photoelectric sensor or the like at an inspection position in a midstream of a falling path, and the density of the obtained image and a predetermined threshold value relevant to density are compared with each other. Based on this comparison result, each grain is determined whether it is defective or not. Further, the grain determined as a defective grain is sorted out by being discharged from the predetermined falling path by blowing air from a high-pressure air valve.

Since the aforementioned conventional color-based sorting apparatus is structured to convey cereal grains to slide through the narrow flowing passage (chute) to send the cereal grains to the inspection position, the speed at which the grains slide through the flowing passage varies depending on properties (moisture or the like) of each grain. Further, cereal grains may frequently fall through the flowing passage jumping and rolling down depending on the shapes of the grains (particularly, soybeans). As a result, the locus of the grains falling through the flowing passage or the speed at which the grains fall becomes irregular. Hence, a timing to sort out each grain in the sorting section after a camera picks up an image in the image pickup section may be off, or a grain may miss the sorting region. Therefore, it is difficult to carry out sorting of defective grains of cereal grains such as rice grains or soybeans with high accuracy.

In order to solve the aforementioned problem, a color-based sorting apparatus using a belt conveyor has already been proposed by the assignee of the present application (see Japanese Patent Application Laid-Open (JP-A) No. 9-122606). In the color-based sorting apparatus disclosed therein, cereal grains on a belt conveyor neither slide, roll nor jump, and fall from the belt conveyor in a stable state. For this reason, the falling-locus of the grains and the speed at which the grains fall becomes regular and defective grains of cereal grains such as rice grains or soybeans can be sorted out with high accuracy.

However, in the aforementioned color-based sorting apparatus using a belt conveyor, practically uses a belt conveyer including a large number of components, and therefore, production costs increase. Further, when a belt conveyor is used, an operation of periodically adjusting tension of a belt or an operation of adjusting twisting of a belt needs to be carried out, thereby resulting in complicated maintenance.

SUMMARY OF THE INVENTION

The present invention has been achieved so as to solve the aforementioned problems, and an object of the present invention is to provide a color-based sorting apparatus in which sorting of defective grains of grains to be sorted, such as cereal grains can be carried out with high accuracy, and reduction of costs and facilitation of maintenance can be realized.

A color-based sorting apparatus according to a first aspect of the present invention is a color-based sorting apparatus in which it is determined whether grains to be sorted which are being moved along a predetermined transference path, are defective or not based on a color of each of the grains, and when it is determined that one of the grains is defective, the defective grain is sorted out, the apparatus comprising: a material supplying device disposed at a side of a starting end of the transference path and provided so as to discharge and supply the grains stored therein; a color detecting device disposed at a downstream side of the material supplying device and detecting a color of each of the grains passing through a setting region; a sorting processing section disposed at a downstream side of the color detecting device and operating to change a transference path for defective grains; a control device, which determines whether each of the grains to be sorted is defective or not based on a detection signal from the color detecting device, and when it is determined that one of the grains is defective, the control device activating the sorting processing section; and a feeding roll disposed between the material supplying device and the color detecting device and rotating around an axial line thereof to cause the grains to be sorted, which are supplied from the material supplying device aligned in an axial direction, to freely fall down toward the color detecting device.

In the color-based sorting apparatus of the first aspect, a rotational speed of the feeding roll may be adjustable.

Further, in the first aspect, a flow controlling mechanism may further be provided between the material supplying device and the feeding roll to control a supplied amount of the grains to be sorted.

Moreover, the flow controlling mechanism may include a flow controlling roll and a flow plate, having the flow plate disposed between the flow controlling roll and the feeding roll.

Still further, a rotational speed of the flow controlling roll may be adjustable.

According to the present invention, when processing is started, grains to be sorted, such as cereal grains stored in the material supplying device are discharged therefrom. The discharged grains to be sorted are placed on the surface of the feeding roll aligned in the axial direction. Due to the feeding roll being rotated around its axial line, the grains placed in an aligned state are made to freely fall down toward the color detecting device. The color detecting device is disposed at the downstream side of the feeding roll and detects the color of each grain which passes through (freely falls in) a set region. The detected result is outputted, as a detection signal, to the control device. In the control device, it is determined whether the grain to be sorted is defective or not based on the detection signal. When it is determined that the grain is defective, an operating signal is outputted to the sorting processing section disposed at the downstream side of the color detecting device. Based on the operating signal, the sorting processing section is activated to change a transference path for defective grains. As a result, non-defective grains pass through a transference path for free falling and defective grains pass through a changed transference path. Thus, defective grains can be sorted and separated from non-defective grains.

As described above, the present invention provides a structure in which the grains to be sorted, such as cereal grains discharged from and supplied by the material supplying device are made to freely fall toward the color detecting device by the feeding roll rotating around an axial line thereof. Therefore, the grains to be sorted freely fall in a stable state without slipping, rolling or jumping. As a result, the falling path or falling speed of the grains to be sorted becomes regular, and sorting of the grains to be sorted can be carried out with high accuracy.

Compared with a conventional belt conveyor-type color-based sorting apparatus, a belt and one of rolls can be eliminated, and therefore, the number of components is reduced and reduction of costs can be achieved.

Further, a belt is not required, and therefore, an operation of adjusting tension of a belt or twisting thereof, which has been conventionally carried out periodically, becomes unnecessary. Accordingly, maintenance work becomes easy.

Moreover, in the present invention, the rotational speed of the feeding roll can be controlled more properly in accordance with properties or shapes of grains to be sorted. Therefore, the falling path or falling speed of the grains becomes regular still further and sorting of defective grains from grains to be sorted (such as cereal grains) can be carried out with even higher accuracy.

A color-based sorting apparatus according to a second aspect of the present invention is a color-based sorting apparatus in which it is determined whether grains to be sorted which are being moved along a predetermined transference path, are defective or not based on a color of each of the grains, and when it is determined that one of the grains is defective, the defective grain is sorted out, the apparatus comprising: a material supplying device disposed at a side of a starting end of the transference path and provided so as to discharge and supply the grains stored therein; a flow controlling mechanism disposed at a downstream side of the material supplying device and used to control an amount of the grains to be sorted that is supplied from the material supplying device; a color detecting device disposed at a downstream side of the material supplying device and detecting a color of each of the grains passing through a setting region; a sorting processing section disposed at a downstream side of the color detecting device and operating to change a transference path for defective grains; a control device, which determines whether each of the grains to be sorted is defective or not based on a detection signal from the color detecting device, and when it is determined that one of the grains is defective, the control device activating the sorting processing section; and a feeding roll disposed between the material supplying device and the color detecting device and rotating around an axial line thereof to cause the grains to be sorted, which are supplied from the flow controlling mechanism aligned in an axial direction, to freely fall down toward the color detecting device.

In the color-based sorting apparatus according to the second aspect, a rotational speed of the feeding roll may be adjustable.

Further, in the second aspect, the flow controlling mechanism may include a flow controlling roll and a flow plate, and the flow plate may be disposed between the flow controlling roll and the feeding roll.

Moreover, a rotational speed of the flow controlling roll may be adjustable.

DESCRIPTION OF THE PREFERRED EMBODIMENTS

A color-based sorting apparatus according to the present invention will now be described with reference to FIGS. 1 to 7.

Figure 1:
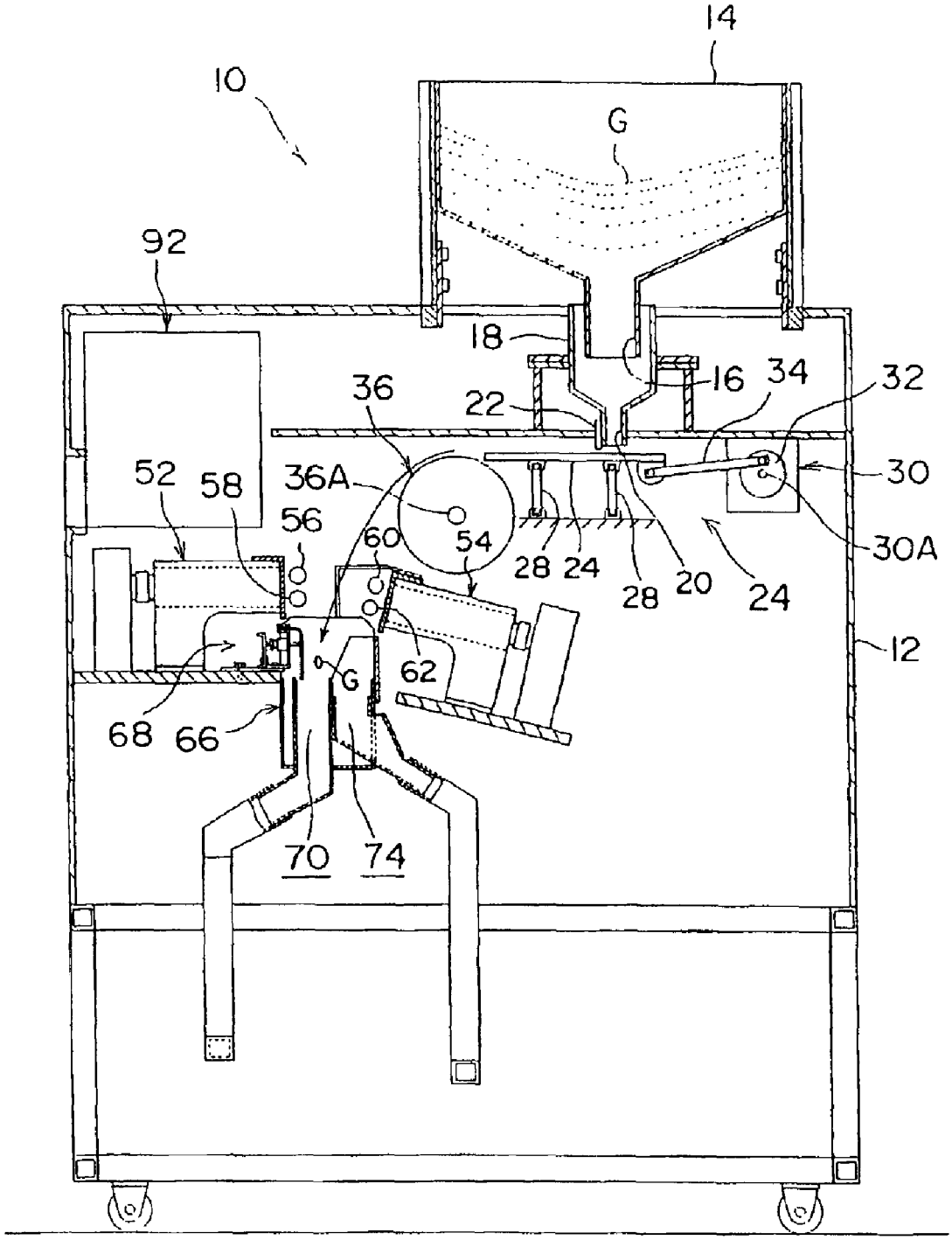
FIG. 1 is a sectional view of a first embodiment of the present invention.
Figure 2:
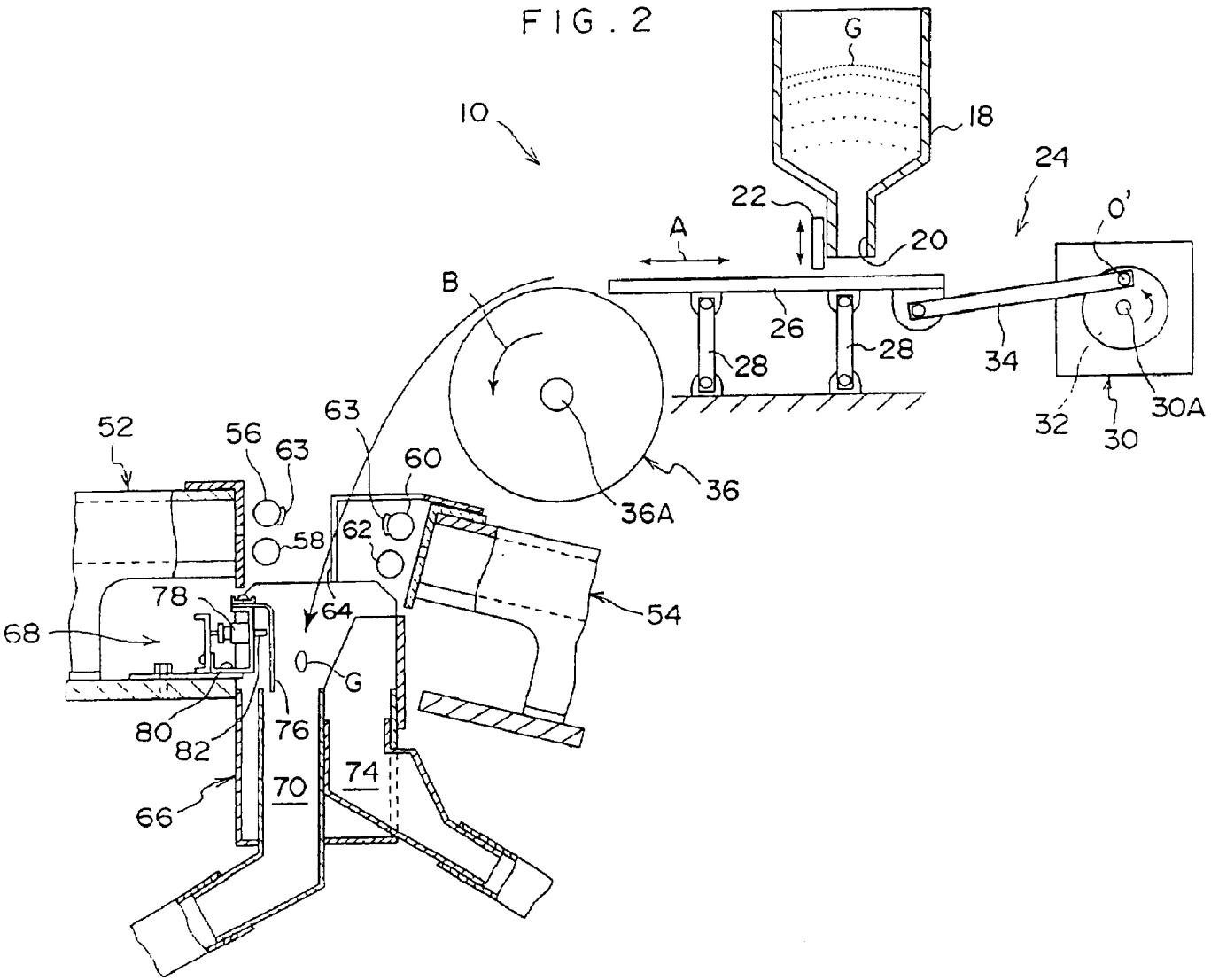
FIG. 2 is an enlarged sectional view of a principal part of the first embodiment of the present invention.

FIG. 1 shows an overall structure of a color-based sorting apparatus 10 for cereal grains according to an embodiment of the present invention. FIG. 2 shows an enlarged diagram of a principal part of the color-based sorting apparatus 10.

As shown in FIGS. 1 and 2, a main body 12 of the color-based sorting apparatus 10 is formed in a box-shape, and a first material-supplying hopper 14, which stores cereal grains G therein and supplies the cereal grains G which are grains to be sorted, is disposed on the top of the main body 12. A lower portion of the first hopper 14 is formed so that an opening area thereof in cross section gradually decreases in a downward direction, and a lowermost portion of the first hopper 14 is formed as a material supply opening 16 having a diameter suitable for supplying the grains G. Further, a second material-supplying hopper 18 having substantially the same shape as the first hopper 14 and having a smaller size than the first hopper 14 is disposed below the first hopper 14. A plate-shaped flow controlling gate 22 is disposed on a side surface of a lower end of the second hopper 18 (in the present embodiment, a side surface on the left side in FIGS. 1 and 2) and adjacent to a material supply port 20. The flow controlling gate 22 is disposed so as to move up and down.

The material-supplying hopper is not necessarily to be formed into a double structure, and the second hopper 18 disposed at the lower side may be omitted. In this case, the flow controlling gate 22 may be disposed on a side surface (in the present embodiment, a side surface on the left side in FIGS. 1 and 2) of a lower end of the first hopper 14, which is disposed at the upper side.

A vibration device 24 is disposed right under the first hopper 14 and is used to supply a predetermined amount of the grains G to a feeding roll 36 (described later). As shown in the enlarged diagram of FIG. 2, the vibration device 24 includes an oscillating plate 26 and a pair of oscillating arms 28 for supporting the oscillating plate 26. The upper surface of the oscillating plate 26 is formed in a staircase pattern so as to supply the grains G to the feeding roll 36 in lines. The upper end of each oscillating arm 28 is connected to a predetermined position on the rear surface of the oscillating plate 26 so as to freely rotate relatively with the oscillating plate 26, and the lower end of the oscillating arm 28 is connected to a predetermined position on the main body 12 so as to freely rotate relatively with the main body 12.

The oscillating plate 26 is disposed substantially horizontally and right under the material supply port 20 of the second hopper 18 with a little space therebetween, and is provided so as to receive the grains G discharged from the material supply port 20. The grains G are supplied to the feeding roll 36 from a space formed between the upper surface of the oscillating plate 26 and the lower end of the flow controlling gate 22.

Further, a drive motor 30 serving as a drive source is disposed at a side of the oscillating plate 26. A substantially circular plate-shaped eccentric cam 32 is fixed on an output shaft 30A of the drive motor 30. The eccentric cam 32 is provided so that an eccentric point O' thereof makes a circular motion around the output shaft 30A due to the output shaft 30A rotating around the axial line thereof. The eccentric point O' of the eccentric cam 32 and a base end (on the right side in FIG. 2) of the oscillating plate 26 are joined to each other by a rod 34. Accordingly, when the drive motor 30 is activated, one end of the rod 34 joined to the eccentric point O' of the eccentric cam 32 makes a circular motion around the output shaft 30A, and at the same time, the oscillating plate 26 reciprocates in right and left directions in FIG. 2 (the directions indicated by double-headed arrow A). Due to the reciprocating movement of the oscillating plate 26, vibration is transmitted to the grains G on the upper surface of the oscillating plate 26 and the grains G are supplied to the feeding roll 36 by being aligned.

The aforementioned first and second material-supplying hoppers 14 and 18, and the vibration device 24 correspond to a material supplying device in the present invention.

The feeding roll 36 is disposed at the side of a front end of the aforementioned oscillating plate 26. A rotating shaft 36A of the feeding roll 36 is connected to a drive motor (not shown) via a belt or the like, and is made to rotate in the direction indicated by arrow B in FIG. 2 due to driving force of the drive motor. The drive motor is connected to a control section 92 (described later), and is rotated at a predetermined rotational speed based on a driving signal from the control section 92. Accordingly, a rotational speed of the feeding roll 36 can be adjusted by adjusting the rotational speed of the drive motor.

Although the surface of the feeding roll 36 having the aforementioned structure is smooth, it may be finished so as to prevent slipping of the grains G thereon or may be comprised of a material which prevents slipping of the grains G (for example, rubber).

A front camera 52 and a rear camera 54, serving as color detecting devices for picking up images of a falling grain G from front and back sides thereof, are disposed below the feeding roll 36, that is, in a direction in which the grain G freely falls from the feeding roll 36.

The front camera 52 and the rear camera 54 are each a line scan camera having 512 pixels, and each camera picks up images of a predetermined linear region which is wider than a locus of the grain G falling from the feeding roll 36. A visual-field central axis of the front camera 52 substantially horizontally, and a pair of fluorescent lamps 56 and 58 serving as light sources are disposed at symmetrical positions with respect to the visual-field central axis. Similarly, a visual-field central axis of the rear camera 54 is slightly inclined downward, and a pair of fluorescent lamps 60 and 62 are disposed at symmetrical positions with respect to the visual-field central axis of the rear camera 54.

The fluorescent lamp 56 is disposed on an extension line of the visual-field central axis of the rear camera 54, and the fluorescent lamp 60 is disposed on an extension line of the visual-field central axis of the front camera 52. A colorimetric plate 63 of a predetermined color is attached to the surface of each fluorescent lamp 56, 60 so as to prevent light from the fluorescent lamp 56 and light from the fluorescent lamp 60 from directly coming into the rear camera 54 and the front camera 56, respectively. These calorimetric plates 63 each have the same reflection factor as that of the grain G regarded as a non-defective grain in the sorting of the present embodiment.

When the grain G falling from the feeding roll 36 arrives at a position in the vicinity of an intersection point of the visual-field central axis of the front camera 52 and the visual-field central axis of the rear camera 54, the image of the grain G is picked up by the front camera 52 and the rear camera 54. Further, a reference plate 64 previously set at a base density (a reference density) is disposed at a position to have an image picked up by the front camera 52 and the rear camera 54.

A region at which image is picked up by the front camera 52 and the rear camera 54, which both are line scan cameras, is divided into a plurality of sections. The divided sections are respectively made to correspond to a plurality of plate springs 76 and solenoids 78 used to drive the plate springs 76 (which will be both described later), and a sorting operation of the grains G is controlled.

A sorting cylinder 66 and an ejector 68, which form a sorting processor, are disposed below the front camera 52 and the rear camera 54 so as to correspond to the grains falling from the feeding roll 36.

The sorting cylinder 66 is provided with a passage 70 for non-defective grains and a passage 74 for defective grains. The passage 70 for non-defective grains is provided at a position in which the grains G freely falling from the feeding roll 36 enter directly from a falling path and can receive the grains G determined as non-defective grains. The passage 74 for defective grains is provided at a position in which the grains G freely falling from the feeding roll 36 can come in when flipped by the ejector 68 (described later), and can receive the grains G determined as defective grains.

The passage 70 for non-defective grains and the passage 74 for defective grains are each led to the outer side of the main body 12 and a terminal portion of each passage is exposed outside. Therefore, the grains G coming into the passages can be discharged outside.

The ejector 68 is disposed above the sorting cylinder 66 (i.e., the passage 70 for non-defective grains) and provided so as to correspond to a free falling path of the grains G. The ejector 68 is provided with a plurality of plate springs 76 each having an L-shaped configuration and solenoids 78 corresponding to the plate springs 76. Each of the plate springs 76 has a predetermined elasticity, and one end of the L-shaped plate spring 76 is fixed to a supporting member 80 and the other end thereof hangs down. Further, each solenoid 78 is fixed at the supporting member 80 in such a manner that a plunger 82 is made perpendicular to the back surface of a corresponding plate spring 76 and can press against the plate spring 76. Due to the ejector 68 being activated, the plate spring 76 elastically deforms to cut in the free falling path of the grains G and can flip a freely falling grain G out of the free falling path.

In the ejector 68 having the aforementioned structure, when the grain G freely falling from the feeding roll 36 has the image picked up by the front camera 52 and the rear camera 54 and a video signal of a picked up image is determined to be lower than a predetermined level, a voltage of about 36 volts is instantaneously applied to the solenoid 78 of a channel corresponding to a region in which an image is picked up. Due to the application of voltage, the plunger 82 instantaneously hits against the plate spring 76 corresponding to the solenoid 78, and the falling grain G is flipped by the plate spring 76. As a result, the grain G is led to the passage 74 for defective grains in the sorting cylinder 66.

The control section 92 serving as a control device is provided in an upper corner portion of the main body 12 of the color-based sorting apparatus 10. The drive motor 30, the front camera 52, the rear camera 54, and the ejector 68 are each connected to the control section 92, and operations thereof are controlled by the control section 92.

Moreover, an operating section (not shown) is provided on a side surface of the main body 12 of the color-based sorting apparatus 10. In the operating section, there is a dial used by an operator to specify various parameters, such as a level (threshold ratio) of a video signal obtained by the front camera 52 and the rear camera 54. There are also buttons in the operating section used to give instructions to start and stop the execution of various processes.

Next, operation and effect of the present embodiment will now be described.

When sorting of the grains G is carried out in the color-based sorting apparatus 10 having the aforementioned structure, teaching processing for initialization is carried out at the time of initial installation of the color-based sorting apparatus 10 or at predetermined time intervals. That is, when an instruction for starting teaching processing is given by a predetermined button operation of an operator, or given automatically at predetermined time intervals, a predetermined region to be photographed is first photographed by the front camera 52 and the rear camera 54, and teaching processing is carried out based on a video signal of an image obtained by photographing. Further, a desired threshold ratio is specified by a dial operation of an operator. Thereafter, when an instruction for starting threshold setting processing is given by a button operation, the threshold setting processing is started. In the threshold setting processing, first, a predetermined region to be photographed is photographed by the front camera 52 and the rear camera 54 in the same manner as in the aforementioned teaching processing, and the threshold setting processing is carried out based on a video signal of an image obtained by photographing.

After the threshold setting processing has been carried out, color-based sorting processing of the grains G is carried out. That is, when the grains G to be sorted are supplied to the first material-supplying hopper 14 by an operator or a predetermined grain input machine, the grains G supplied to the first hopper 14 are sent from the material supply port 16 of the first hopper 14 to the second material-supplying hopper 18. The grains G are further discharged from the material supply port 20 and are dropped and received on the oscillating plate 26.

A predetermined vibration is applied by the vibration device 24 to the oscillating plate 26. That is, when the drive motor 30 is activated by a driving signal from the control section 92, the eccentric cam 32 carries out an eccentric movement around the output shaft 30A. When the eccentric movement is transmitted via the rod 34 to the oscillating plate 26, the oscillating plate 26 oscillates in the right and left directions in FIG. 2 (in the directions indicated by the double-headed arrow A) and the vibration is applied to the grains G on the oscillating plate 26. As a result, the grains G are discharged from a space between the lower end of the flow controlling gate 22 and the upper surface of the oscillating plate 26 by a predetermined amount at a time, and the grains G are supplied to the feeding roll 36 aligned, that is, in a state of being uniformly scattered.

The grains G placed on the surface of the feeding roll 36 freely fall down from the feeding roll 36 due to the feeding roll 36 rotating at a predetermined rotational speed. In midstream of the falling path, the grains G are each photographed by the front camera 52 and the rear camera 54.

Video signals for an image including the grain G photographed by the front camera 52 and the rear camera 54 are each outputted to the control section 92. In the control section 92, based on the video signals for an image including the photographed grain G, a pixel having a video signal level lower than a set threshold is detected, thereby allowing detection of a defective grain. Further, a channel in which the pixel exists, that is, a channel corresponding to a region in which a defective grain falls can be specified.

As a result, a voltage of about 36 volts is instantaneously applied by the control section 92 to the solenoid 78 provided so as to correspond to each channel. Consequently, the plunger 82 of a channel corresponding to the grain G determined as a defective grain protrudes and the plate spring 76 of the channel is made to elastically deform to protrude toward the free falling path of the grain G. The protruded plate spring 76 flips the grain G to the passage 74 for defective grains of the sorting cylinder 66.

When no pixel having a video signal level lower than the set threshold is detected, it is determined that no defective grain is included in the falling grains G. Therefore, the solenoid 78 is not energized and there is no possibility that the plate spring 76 may be made to elastically deform and protrude. Accordingly, the free falling grains G fall into the passage 70 for non-defective grains in the sorting cylinder 66 without being flipped by the plate spring 76, and the grains G are discharged outside the device.

As described above, in the color-based sorting apparatus 10 according to the present embodiment, the grains G discharged from the material supply port 16 of the first material-supplying port 14 are uniformly scattered on the oscillating plate 26 by the vibration device 24, and the grains G, which are aligned, are placed on the surface of the single feeding roll 36 and made to freely fall toward the front camera 52 and the rear camera 54. Therefore, the falling path or falling speed of the grains G becomes uniform and sorting of defective grains can be carried out with high accuracy.

Further, compared with a conventional belt conveyor-type color-based sorting apparatus, a belt and one of rolls can be omitted. Accordingly, in the color-based sorting apparatus 10 of the present embodiment, the number of components can be reduced and cost reduction can be achieved.

Moreover, when a belt is eliminated, an operation of adjusting tension of the belt or twisting thereof, which has been conventionally carried out periodically, become unnecessary. Accordingly, facilitation of maintenance can be achieved.

In addition, in the color-based sorting apparatus 10 according to the present embodiment, the rotational speed of the feeding roll 36 can be more properly controlled by the control section 92 in accordance with properties or shapes of grains to be sorted. As a result, the falling-path or falling-speed of the grains G becomes more regular and sorting of defective grains from grains to be sorted, such as cereal grains G can be carried out with even higher accuracy.

Figure 3:
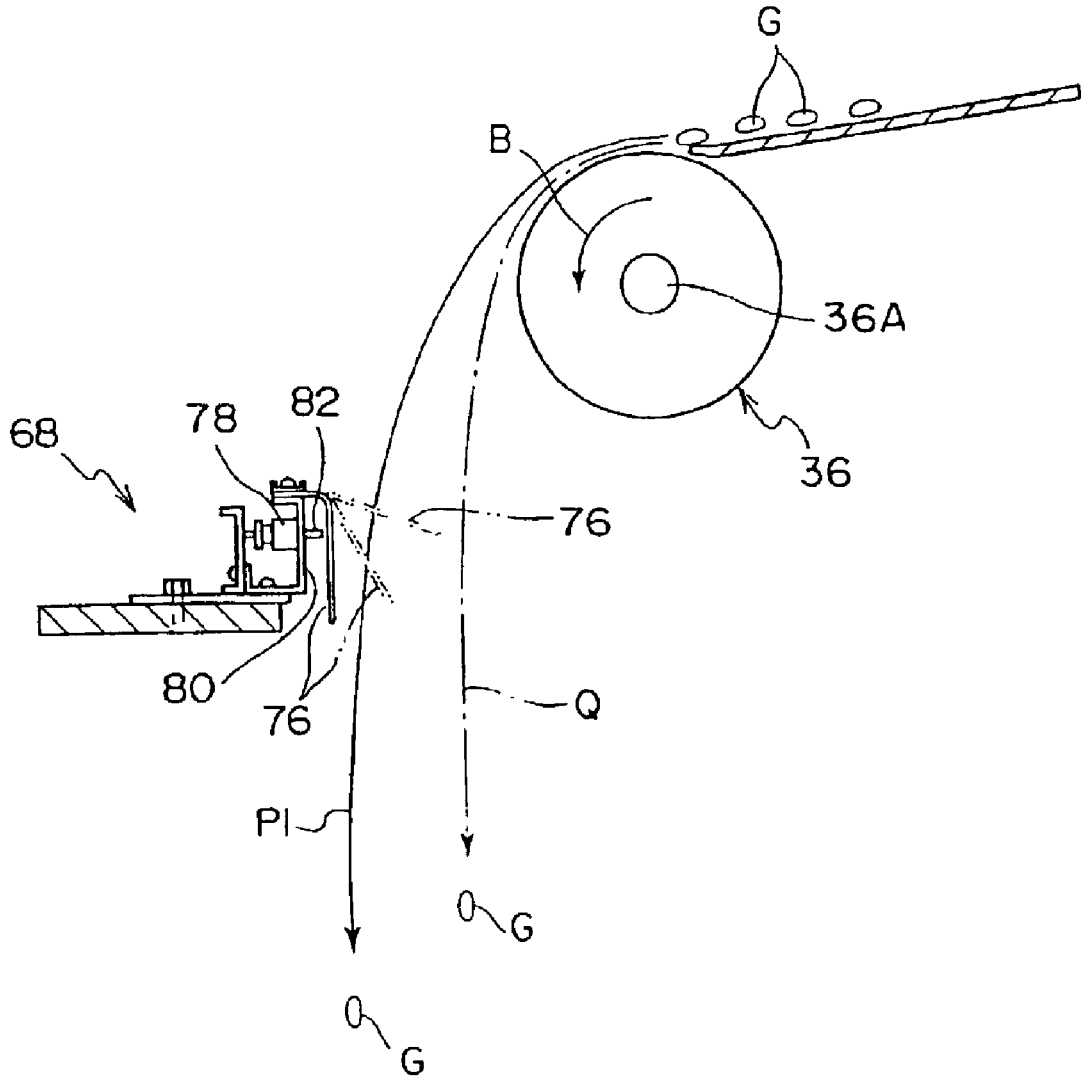
FIG. 3 is a side view showing an effect of the first embodiment of the present invention in comparison with that of a conventional art.

More specifically, for example, if the rotational speed of the feeding roll 36 is slow when the grain G placed on the surface of the feeding roll 36 freely falls therefrom as shown in FIG. 3, the grain G may slip on the surface. In this case, the falling path of the grain G becomes a transference path Q indicated by one-dot chain line in FIG. 3. The transference path Q is positioned nearer to the feeding roll 36 than a transference path P1 which is a path when no slipping occurs. That is, the grain G passes through a position far from the ejector 68 and the falling speed of the grain G is also slow. Therefore, the timing of sorting is off. As a result, there exists a problem in which a sorting function by the ejector 68 does not operate and defective grains cannot be properly sorted out.

Figure 4:
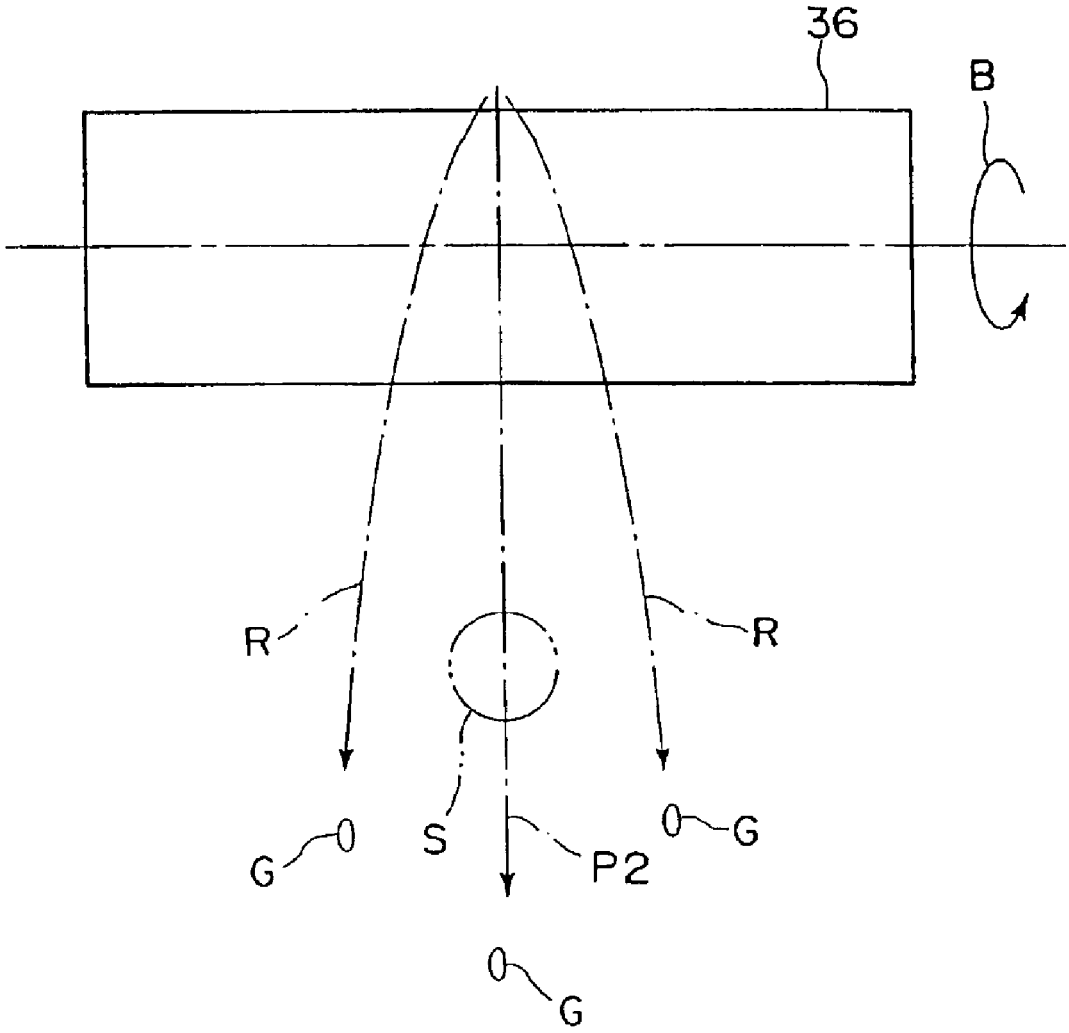
FIG. 4 is a front view showing an effect of the first embodiment of the present invention in comparison with that of a conventional art.

Further, as shown in FIG. 4, when the grain G placed on the surface of the feeding roll 36 freely falls down from the feeding roll 36, the grain G may rotate (or roll) on the surface of the feeding roll 36. In this case, the falling path of the grain G mostly becomes as the transference path R indicated by one-dot chain line in FIG. 4 in almost cases. The transference path R displaced in an axial direction of the feeding roll 36 than a transference path P2 which is a path when no rotation or rolling occurs. That is, the grain G passes through a position offset from the sorting region S of the ejector 68 and the falling speed of the grain G is also slow. As a result, a problem such that a sorting operation by the ejector 68 cannot be carried out and defective grains cannot be properly sorted out.

In the color-based sorting apparatus 10 according to the present embodiment, the rotational speed of the feeding roll 36 is more properly adjusted in accordance with properties or shapes of grains to be sorted, such as cereal grains G, thereby making it possible to keep slipping and rotation of the grains G to the minimum. As a result, the falling path and falling speed of the grains G can be made regular and substantially uniform. That is, the transference path of the grains G is indicated by P1 when seen from the side and is indicated by P2 when seen from the front. Accordingly, it is possible to improve the accuracy of sorting out defective grains by the ejector 68.

Further, in the color-based sorting apparatus 10 of the present embodiment, the feeding roll 36 is used in place of a belt conveyor. Therefore, not only the number of components can be reduced, but also an installation space for the apparatus can be reduced. Accordingly, the color-based sorting apparatus 10 can be made smaller and become lightweight in the present embodiment.

In the color-based sorting apparatus 10 of the present embodiment, a material supplying device including the first and second material-supplying hoppers 14 and 18, the vibration device 24 and the like is used. However, the present invention is not limited to the same, and various structures can be used. Some of variations of the material supplying device will be described hereinafter. Note that, in the following description, the same component parts as those of the aforementioned embodiment will be denoted by the same reference numerals, and a description thereof will be omitted.

[Material Supplying Device]

Figure 5:
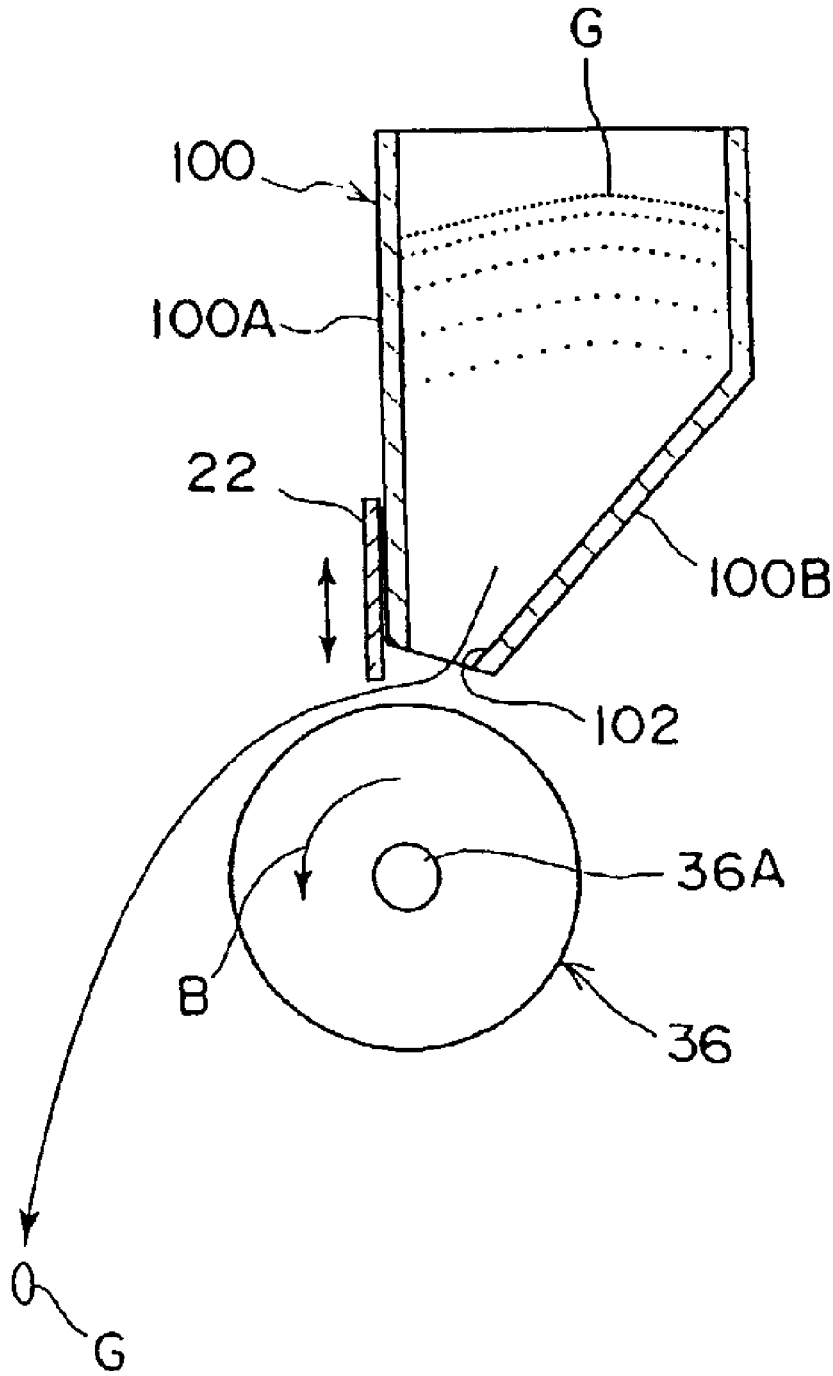
FIG. 5 is a sectional view of a second embodiment showing a material supplying device of the present invention.

The structure shown in FIG. 5 is characterized by having a material supply port 102 of a material-supplying hopper 100 disposed in the vicinity of the upper end of the feeding roll 36. The vibration device 24 is eliminated. In other words, the grain G is directly supplied to the feeding roll 36 with no member or device interposed between the material supply port 102 of the material-supplying hopper 100 and the feeding roll 36.

The material supplying hopper is provided with a vertical wall 100A and an inclined wall 100B. The vertical wall 100A is disposed on a substantially vertical line passing through the rotation center of the feeding roll 36. Accordingly, the material supply port 102 of the material supplying hopper 100 is disposed at a position slightly apart from the upper end of the feeding roll 36 at an upstream side in the rotating direction of the feeding roll 36.

According to the aforementioned structure, the grains G stored in the material supplying hopper 100 are supplied to a portion of the feeding roller 36 slightly on a right side of the upper end thereof (at the upstream side in the rotating direction) from the material supply port 102. The supplied grains G receive conveying force in the rotating direction by the feeding roll 36 and are stopped at the lower end of the flow controlling gate 22. Thereafter, only the amount of the grains G corresponding to an opening formed by the flow controlling gate 22 pass through the flow controlling gate 22. The passing grains G are placed on the surface of the feeding roll 36 substantially uniformly and made to freely fall down on the color detecting device due to rotation of the feeding roll 36.

The aforementioned structure is very simple and allows cost reduction. Further, a small installation space suffices and the apparatus can be made smaller and become lightweight.

Figure 6:
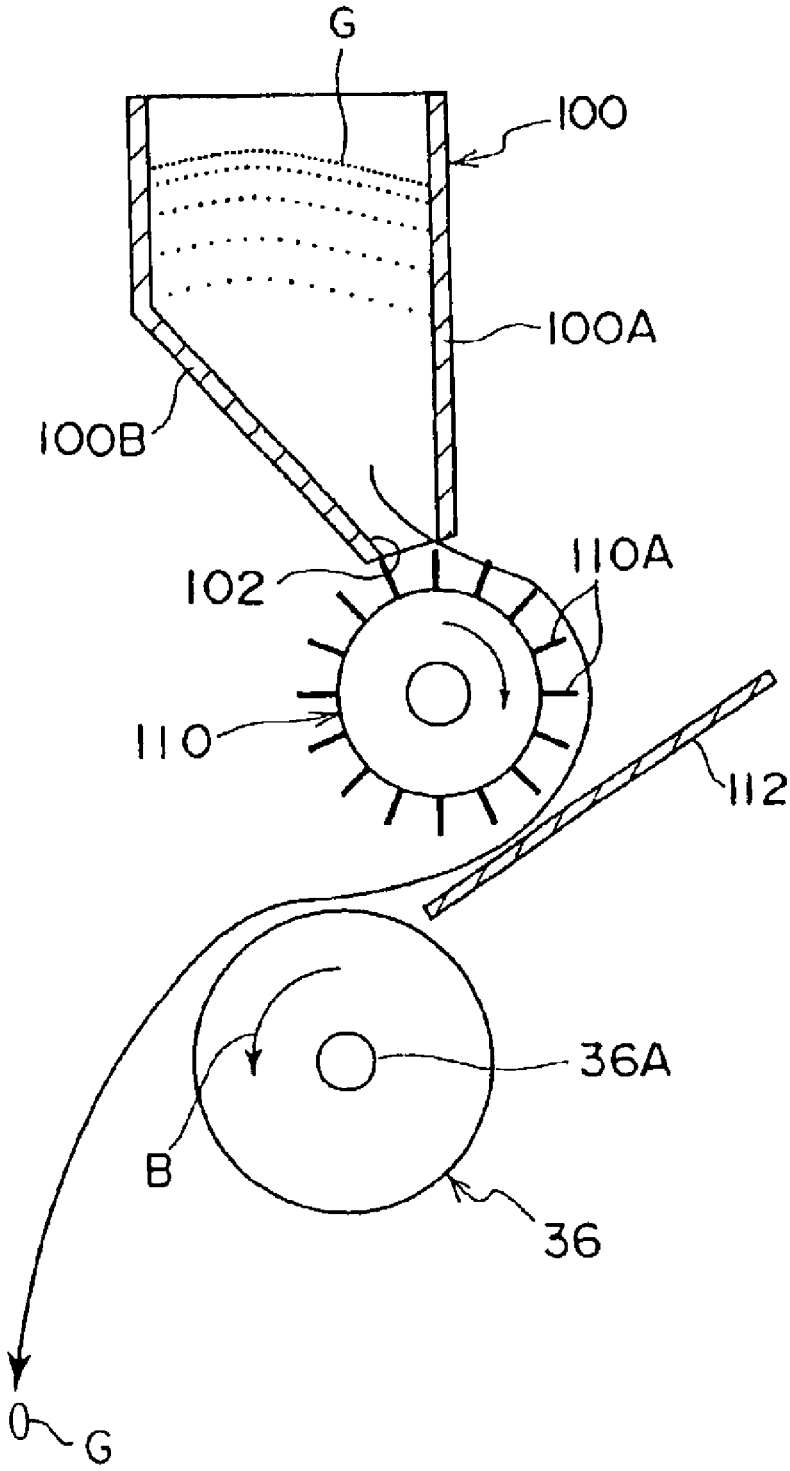
FIG. 6 is a sectional view of a third embodiment showing the material supplying device of the present invention.

The structure shown in FIG. 6 is characterized by having a flow controlling roll 10 serving as a flow controlling mechanism for controlling a supply amount of the grains G. A grain flow plate 112 is disposed between the material supplying hopper 100 and the feeding roll 36. Vanes 110A are formed upright on an outer peripheral surface of the flow controlling roll 110 at predetermined intervals. Further, the rotational speed of the flow controlling roll 110 can be controlled. The grain flow plate 112 is disposed at a predetermined angle of inclination.

According to the aforementioned structure, the grains G discharged from the material supply port 102 of the material supplying hopper 100 are temporarily stored between the vanes 110A of the flow controlling roll 110, and thereafter, made to fall on the grain flow plate 112. The fallen grains G slides on the grain flow plate 112 and are supplied at a predetermined position on the surface of the feeding roll 36.

Accordingly, this structure may be disadvantageous such that the number of components increases and the structure thereby becomes complicated compared with the structure shown in FIG. 5. However, the structure shown in FIG. 6 includes the flow controlling roll 110 which can control the rotational speed, and therefore, it has an advantage in that the accuracy of supplying the grains to the feeding roll 36 (the degree of uniformity and alignment) improves.

Figure 7:
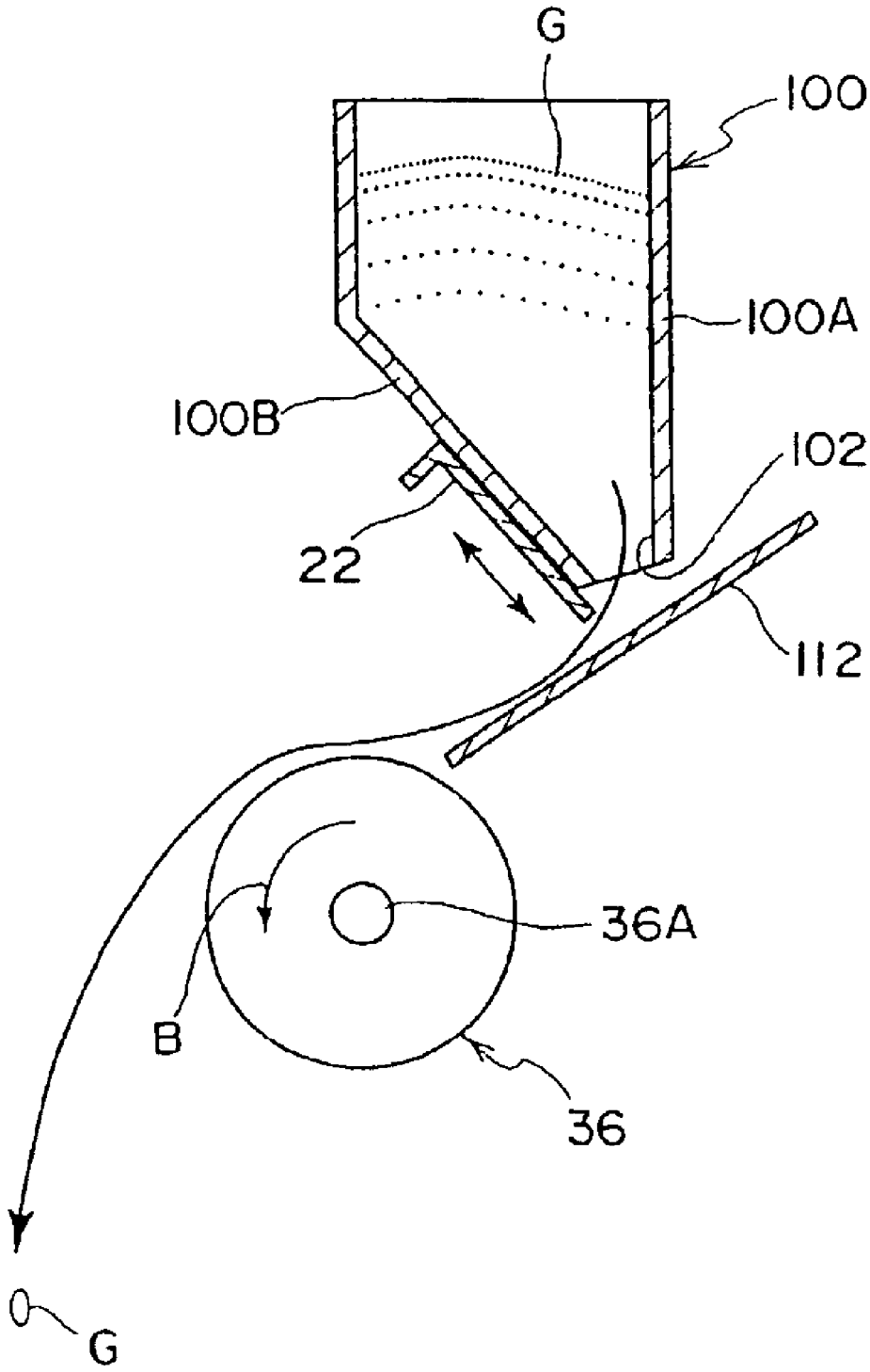
FIG. 7 is a sectional view of a fourth embodiment showing the material supplying device of the present invention.

The structure shown in FIG. 7 is characterized by having the grain flow plate 112 (and the flow controlling gate 22 integrated with the material supplying hopper 100) disposed between the material supplying hopper 100 and the feeding roll 36. In other words, the structure is substantially a combination of the structure shown in FIG. 5 and the structure shown in FIG. 6, that is, a structure using the flow controlling gate 22 in place of the flow controlling roll 110.

According to the aforementioned structure, the grains G supplied from the material supply port 102 of the material supplying hopper 100 are provided so as to temporarily fall on the grain flow plate 112 and further flow down. At this time, the flow controlling gate 22 serves to stop the flowing grains G, and therefore, the grains G are supplied to the surface of the feeding roll 36 in the state of being aligned substantially uniformly.

Accordingly, the aforementioned structure possesses the beneficial effects both of the structures shown in FIGS. 5 and 6 (that is, the accuracy of supplying grains to the feeding roller 36 can be improved to some degree at a low cost).

[Sorting Processing]

The aforementioned present embodiment is constructed so that defective grains are sorted out by carrying out one sorting processing. However, the present invention is not limited to the same and defective grains may also be sorted out by carrying out sorting processing in plural times. For example, a group of grains G in a fixed region including defective grains is sorted out into a sorting route by primary sorting processing, and when the grains G are sent again to the feeding roll, color detection is carried out for each of the grains G that are being supplied to the surface of the feeding roll one by one, and only defective grains are discarded by secondary sorting processing.

Further, in the present embodiment, the system having a plate spring and a solenoid is used as the sorting processor, but the present invention is not limited to the same. For example, an air ejector system using an air nozzle and an electromagnetic valve may be used or other sorting processor may also be used.

Moreover, in the present embodiment, a mechanical vibration device 24 is used. However, the present invention is not limited to the same and an electrical vibration device may also be used.

Furthermore, in the present embodiment, the color-based sorting apparatus 10 is used for the grains G such as rice grains or soybeans, but the present invention is not limited to the same for which the color-based sorting apparatus of the present invention is used. For example, granulated plastic pieces or the like may also be applied to sorting by the color-based sorting apparatus according to the present invention.

As described above, in the color-based sorting apparatus according to the present invention, a feeding roll is disposed between a material supplying device and a color detecting device, which feeding roll rotates around the axis thereof to allow grains to be sorted, which are supplied from a material supplying device in a state of being aligned in an axial direction of the feeding roll, to freely fall down toward a color detecting device. Therefore, defective grains can be sorted out from grains to be sorted (such as cereal grains) with high accuracy. Furthermore, the present invention has an excellent effect such that, compared with a conventional belt conveyor-type color-based sorting apparatus, cost reduction and facilitation of maintenance can be achieved.

Furthermore, the rotational speed of the feeding roll can be adjusted, and therefore, it becomes possible to adjust (control) the rotational speed of the feeding roll more properly in accordance with properties or a shape of grains to be sorted. As a result, the present invention has an excellent effect in that the accuracy of sorting defective grains by the sorting processor can be further improved.

What is claimed is:

1. A color-based sorting apparatus in which it is determined whether grains to be sorted which are being moved along a predetermined transference path, are defective or not based on a color of each of the grains, and when it is determined that one of the grains is defective, the defective grain is sorted out, said apparatus comprising:

a material supplying device disposed at a side of a starting end of the transference path and provided so as to discharge and supply the grains stored therein;

a color detecting device disposed at a downstream side of said material supplying device and detecting a color of each of the grains passing through a setting region;

a sorting processing section disposed at a downstream side of said color detecting device and operating to change a transference path for defective grains;

a control device, which determines whether each of the grains to be sorted is defective or not based on a detection signal from said color detecting device, and when it is determined that one of the grains is defective, said control device activating said sorting processing section; and a feeding roll disposed between said material supplying device and said color detecting device and rotating around an axial line thereof to cause the grains to be sorted, which are supplied from said material supplying device aligned in an axial direction, to freely fall down toward said color detecting device wherein a rotational speed of said feeding roll is adjustable.

2. The apparatus of claim 1, further comprising a flow controlling mechanism provided between said material supplying device and said feeding roll to control a supplied amount of the grains to be sorted.

3. The apparatus of claim 2, wherein said flow controlling mechanism includes a flow controlling roll and a flow plate, and the flow plate is disposed between the flow controlling roll and said feeding roll.

4. The apparatus of claim 3, wherein the flow controlling roll has a plurality of vanes on an outer periphery thereof.

5. The apparatus of claim 4, wherein a rotational speed of the flow controlling roll is adjustable.

6. The apparatus of claim 1, wherein said material supplying device further includes a flow controlling gate for supplying a predetermined amount of the grains to be sorted at a time.

7. The apparatus or claim 6, wherein said material supplying device comprises at least one hopper and a vibration device, and the vibration device is disposed between the at least one hopper and said feeding roll.

8. The apparatus of claim 7, wherein the vibration device includes an oscillating plate and a drive source, and, when the oscillating plate is disposed slightly apart from a supply port of the at least one hopper and grains to be sorted are supplied to an upper surface of the oscillating plate, the drive source is activated to oscillate the oscillating plate, thereby supplying the grains to be sorted, which have been supplied to the upper surface of the oscillating plate, to said feeding roll in an aligned state.

9. The apparatus of claim 8, wherein said color detecting device includes at least one pair of line scan cameras, and the at least one pair of line scan cameras are disposed at positions from which front and back surface images of the grains to be sorted can be picked up thereby, with a falling path of the grain to be sorted, which freely falls from said preceding roller, interposed between the line scan cameras.

10. The apparatus of claim 9, wherein a pair of light sources are disposed at symmetrical positions with respect to each visual-field central axis of the at least a pair of line scan cameras.

11. The apparatus of claim 10, wherein one light source of a pair of light sources disposed at symmetrical positions with respect to a visual-field central axis of one line scan camera of the at least a pair of line scan cameras is disposed at a position on an extension line of a visual-field central axis of a line scan camera corresponding to the one line scan camera, and one light source of a pair of light sources disposed at positions symmetrical to the visual-field central axis of the line scan camera corresponding to the one line scan camera is disposed at a position on an extension line of the visual-field central axis of the one line scan camera.

12. The apparatus of claim 11, wherein a colorimetric plate of a predetermined color is mounted at each of the light sources disposed on extension lines of respective visual-field central axes or the at least a pair of line scan cameras.

13. The apparatus of claim 12, wherein each or the light sources comprises of a fluorescent lamp.

14. The apparatus or claim 1, wherein said sorting processing section includes a sorting cylinder and an ejector.

15. The apparatus of claim 14, wherein the sorting cylinder has a passage for non-defective grains and a passage for defective grains.

16. A color-based sorting apparatus in which it is determined whether grains to be sorted which are being moved along a predetermined transference path, are defective or not based on a color of each of the grains, and when it is determined that one of the grains is defective, the defective grain is sorted out, said apparatus comprising:

a material supplying device disposed at a side of a starting end of the transference path and provided so as to discharge and supply the grains stored therein;

a flow controlling mechanism disposed at a downstream side of said material supplying device and used to control an amount of the grains to be sorted that is supplied from said material supplying device;

a color detecting device disposed at a downstream side of said material supplying device and detecting a color of each of the grains passing through a setting region;

a sorting processing section disposed at a downstream said of said color detecting device and operating to change a transference path for defective grains;

a control device, which determines whether each of the grains to be sorted is defective or not based on a detection signal from said color detecting device, and when it is determined that one of the grains is defective, said control device activating said sorting processing section; and a feeding roll disposed between said material supplying device and said color detecting device and rotating around an axial line thereof to cause the grains to be sorted, which are supplied from said flow controlling mechanism aligned in an axial direction, to freely fall down toward said color detecting device wherein a rotational speed of said feeding roll is adjustable.

17. A color-based sorting apparatus in which it is determined whether grains to be sorted which are being moved along a predetermined transference path, are defective or not based on a color of each of the grains, and when it is determined that one of the grains is defective, the defective grain is sorted out, said apparatus comprising:

a material supplying device disposed at a side of a starting end of the transference path and provided so as to discharge and supply the grains stored therein;

a flow controlling mechanism disposed at a downstream side of said material supplying device and used to control an amount of the grains to be sorted that is supplied from said material supplying device wherein said flow controlling mechanism includes a flow controlling roll and a flow plate, and the flow plate is disposed between the flow controlling roll and said feeding roll;

a color detecting device disposed at a downstream side of said material supplying device and detecting a color of each of the grains passing through a setting region;

a sorting processing section disposed at a downstream of said color detecting device and operating to change a transference path for defective grains; a control device, which determines whether each of the grains to be sorted is defective or not based on a detection signal from said color detecting device, and when it is determined that one of the grains is defective, said control device activating said sorting processing section; and a feeding roll disposed between said material supplying device and said color detecting device and rotating around an axial line thereof to cause the grains to be sorted, which are supplying from said flow controlling mechanism aligned in an axial direction, to freely fall down toward said color detecting device.

18. The apparatus of claim 17, wherein a rotational speed of the flow controlling roll is adjustable.

* * * * *